US007575028B2

(12) United States Patent
Thorpe et al.

(10) Patent No.: US 7,575,028 B2
(45) Date of Patent: Aug. 18, 2009

(54) HYDRAULIC INTERLOCKING FUEL NOZZLE

(76) Inventors: Douglas G. Thorpe, 707 Broadway, Irvine, KY (US) 40336; Norwood Thorpe, 68 Forest Hill Dr., Irvine, KY (US) 40336

( * ) Notice: Subject to any disclaimer, the term of this patent is extended or adjusted under 35 U.S.C. 154(b) by 427 days.

(21) Appl. No.: 11/164,497

(22) Filed: Nov. 25, 2005

(65) Prior Publication Data

US 2007/0034282 A1 Feb. 15, 2007

Related U.S. Application Data

(63) Continuation-in-part of application No. 11/037,929, filed on Jan. 19, 2005, now Pat. No. 7,000,657.

(51) Int. Cl.
*B65B 1/04* (2006.01)

(52) U.S. Cl. ..... 141/347; 141/207; 141/346; 141/392

(58) Field of Classification Search ..... 141/207, 141/346, 347, 392; 251/149.9; 137/614.6
See application file for complete search history.

(56) References Cited

U.S. PATENT DOCUMENTS

| | | | | |
|---|---|---|---|---|
| 1,457,535 | A | 6/1923 | McCune | |
| 1,515,844 | A | 11/1924 | Dorris | |
| 1,726,044 | A | 8/1929 | Seidel | |
| 2,547,690 | A | 4/1951 | Chadil et al. | |
| 3,502,121 | A | 3/1970 | Moore et al. | |
| 3,683,976 | A * | 8/1972 | Remane | 141/59 |
| 4,354,536 | A * | 10/1982 | Moss | 141/383 |
| 4,557,302 | A | 12/1985 | Sunderhaus | |
| 5,236,023 | A | 8/1993 | Mohr | |
| 5,385,182 | A | 1/1995 | Dyer | |
| 6,123,123 | A | 9/2000 | Carder et al. | |
| 6,799,614 | B1 * | 10/2004 | Smith et al. | 141/312 |
| 7,000,657 | B1 * | 2/2006 | Thorpe et al. | 141/207 |
| 7,017,630 | B2 * | 3/2006 | Dikken | 141/392 |

* cited by examiner

*Primary Examiner*—Timothy L Maust
(74) *Attorney, Agent, or Firm*—Clyde I. Coughenour

(57) ABSTRACT

A fuel dispensing nozzle is provided with fuel activated levers that engage the vehicle fill pipe to prevent drive-off without paying. Fuel pump pressure acts on plungers to pivot fill pipe levers, against spring pressure, to lock the two together. Movement of the levers is initially prevented by a trigger that is spring biased forward on the nozzle spout. Since the fill pipe is not large enough to pass the trigger, insertion of the spout into the fill pipe moves the trigger against spring pressure to uncover the levers. The levers are locked to the fill pipe as long as pump pressure is present. Removal of fuel pressure allows the levers to be withdrawn by spring action. A breakaway joint is provided to stop fuel flow in the event of drive-off with the fuel nozzle in a fuel filled pipe.

20 Claims, 7 Drawing Sheets

HYDRAULIC INTERLOCKING FUEL NOZZLE

This is a Continuation-in-Part of your applicant's prior application Ser. No. 11/037,929 filed Jan. 19, 2005, and now U.S. Pat. No. 7,000,657 issued Feb. 21, 2006.

BACKGROUND OF THE INVENTION

1. Field of the Invention

An interlocking mechanism locks a fuel dispensing nozzle to a fill pipe at a filling station to prevent drive-off without payment. Initial fuel pressure at the pump presses locking levers out against spring pressure with the locking levers released to lock by trigger movement when the nozzle is inserted into the fill pipe. Removal of fuel pressure allows spring retraction of the levers.

2. Description of Related Art

The concept of providing fuel nozzles with spout extensions to secure the nozzle to a fuel tank to prevent spilling and need to hold the nozzle are old. M. McCune, U.S. Pat. No. 1,457,535, issued Jun. 5, 1923, and L. Dorris, U.S. Pat. No. 1,515,844, issued Nov. 18, 1924, and J. Seidel, U.S. Pat. No. 1,726,044, issued Aug. 27, 1929, and R. Chadil et al, U.S. Pat. No. 2,547,690, issued Apr. 3, 1951, and G. Moore et al, U.S. Pat. No. 3,502, 121, issued Mar. 24, 1970, and J. Moss, U.S. Pat. No. 4,354, 536, issued Oct. 19, 1982, and C. Sunderhaus, U.S. Pat. No. 4,557,302, issued Dec. 10, 1985, and R. Mohr, U.S. Pat. No. 5,236,023, issued Aug. 17, 1993, and B. Dyer, U.S. Pat. No. 5,385,182, issued Jan. 31, 1995, are examples. The use of pull away parts to preclude unnecessary damage when a vehicle operator pulls off with the nozzle still in the fill pipe is known with M. Carder et al, U.S. Pat. No. 6,123,123, issued Sep. 26, 2000, examples.

SUMMARY OF THE INVENTION

The present fuel nozzle will enable service stations that dispense fuel to customer vehicles to provide a locking mechanism between the nozzle and the fill pipe of a vehicle's gas tank so that the release of the nozzle is under the control of the service station attendant/cashier. The motivation for this invention is the problem of drive-offs, unintentional or otherwise, costing service station owners and operators about $270 million per year across the United States. A typical drive-off involves $25.30 at a fuel price of $1.75 per gallon and thus is not a felony; therefore, there is little incentive to worry about prosecution from the point of view of the accused gas thief, and from the point of view of the service station owner. The invention should reduce drive-offs, or at least make those who continue to drive off more fearful of prosecution.

A fuel filler neck restrictor plate in the fuel filler pipe of cars manufactured since 1974 prevents filling of leaded gasoline or other fuels from a larger nozzle diameter. The fuel dispensing nozzle comprises a double lever mechanism that interlocks with the fill pipe of vehicles, particularly the fuel filler neck restrictor required by unleaded fuel vehicles. Fuel pump pressure is applied to engage the levers. These latches will have 10 psi of fluid pressure being supplied by the incoming tube from the poppet valve chamber as long as fuel under pressure is present. A trigger on the nozzle spout prevents engagement of the latches or levers with the fill pipe until the nozzle is inserted into a fill pipe. Since the trigger is too large to fit through the restrictor, it is moved inward on the nozzle spout against spring pressure to uncover the levers and permit them to engage the fill pipe. The interlocking mechanism is activated by initial insertion of the spout, and is maintained by fuel pressure transmitted by a tube that connects the poppet valve chamber to lever actuators inside of the spout. When, and only when, the attendant/cashier turns off the pump, the fluid pressure is removed from the plunger and the latches allowing the latches to retract back into the spout by latch spring pressure, which in turn permits the dispensing nozzle to be safely removed from the customer's vehicle. If the customer fails to pay the cashier and drives off, a breakaway joint between the nozzle and hose will fail, as mandated by OSHA, disconnecting the nozzle from the hose. This breakaway occurs whenever a force >350 lbs. is applied with less than an ounce of fuel spilled as a result of the breakaway. This invention will not interfere with the automatic "pay at the pump" dispensing operation. The customer could merely hit a button on the "pay at the pump" panel to turn off the pump.

DESCRIPTION OF THE PREFERRED EMBODIMENTS

The invention modifies the standard fuel nozzle with a drive-off prevention system by adding a fuel fill pipe restrictor grasp assembly in the nozzle spout.

Figure 1:
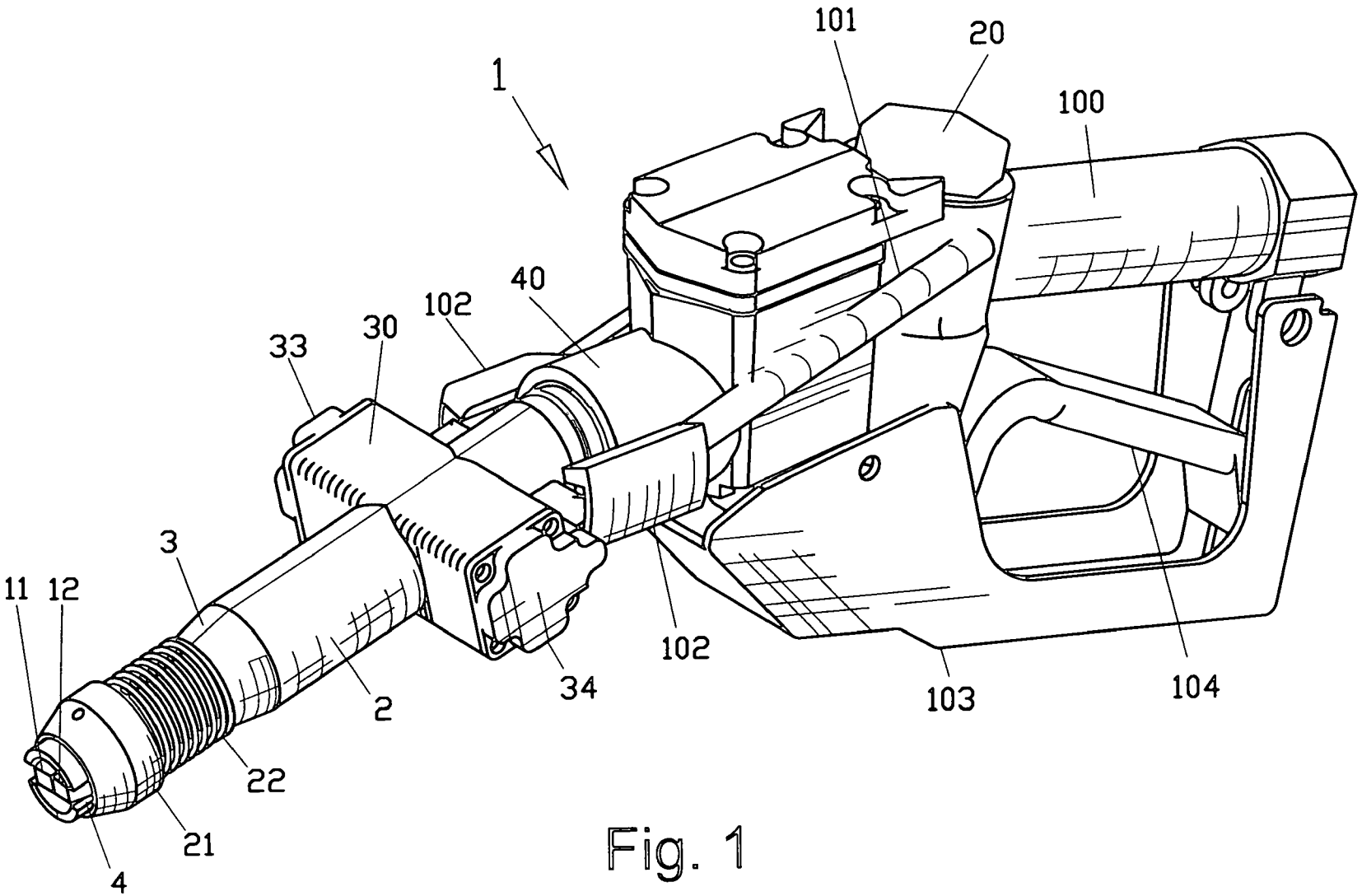
FIG. 1 is a perspective view of the fuel nozzle of the invention.

The modified nozzle 1 is shown in FIG. 1. The nozzle has a tube or passage 101 routed from the poppet valve chamber 20 to the spout 2 plunger housing 30. A tube guard 102 is intended to protect the tube extension to the spout from damage due to routine insertion and otherwise. Fuel from the pump enters the nozzle 1 through the handle conduit 100 and passes into the poppet valve housing 20, through the poppet valve tubes 101 past the venturi assembly 40 into the plunger assembly 30 when the fuel pump is activated.

Figure 2:
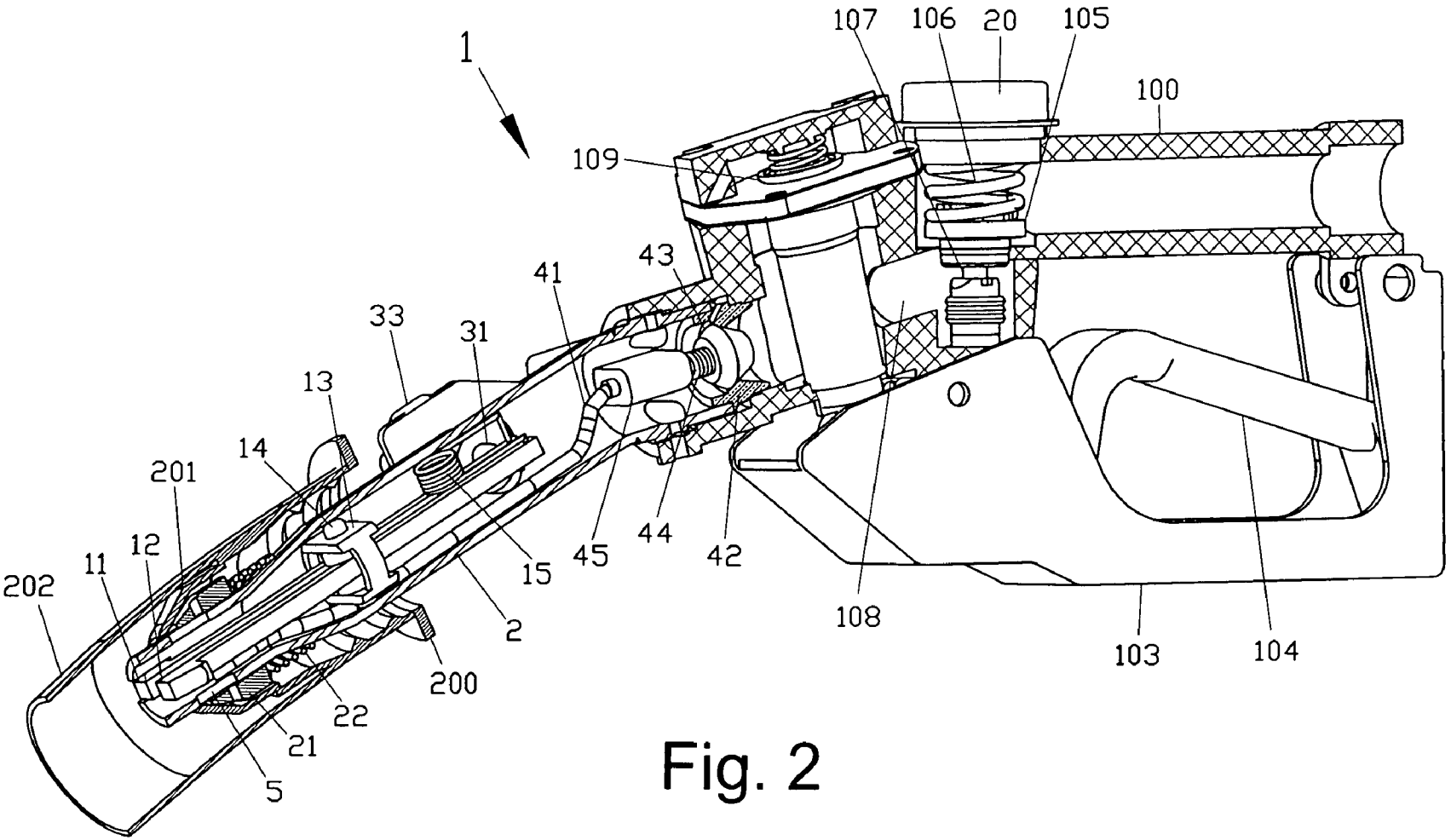
FIG. 2 is a perspective view of the fuel nozzle of the invention in a fill pipe with a section broken away.

As seen in FIG. 2, a manually activated handle driven poppet valve 105 allows the customer to regulate the standard 10 psi of fuel pressure delivered by the pump. The vehicle filler pipe 200 is where the fuel enters the car for storage and it houses the fill neck restrictor 201. The nozzle also contains a 13/16 inch diameter metal or plastic fuel spout, which is inserted past the fuel tank fuel filler neck restrictor now present on the fill pipes of all vehicles using unleaded fuel since 1974.

The fuel lever 104, within hand guard 103, is pressed to pump fuel into a fuel tank fill tube 202. The standard plastic guard 103 helps retain the lever as well as protect against an accidental dispensing of gasoline.

The valve stem 107 communicates the action of the upward motion of the hand lever 104 to the poppet valve 105 and to the main poppet valve spring 106. Pressing on the fuel lever 104 lifts the poppet valve 105 off of its seat against poppet valve spring 106 pressure through valve stem 107. This admits fuel into nozzle passage 108 and to the venturi assembly 40 and out to the spout 2. At the entrance to the venturi assembly is a venturi plug 43 that seats against venturi ring 42 due to venturi spring 44.

The internal components of the present spout end of the nozzle are shown in FIGS. 2-7. The spout section has been designed to take advantage of the 10 psi fluid pressure being supplied from the poppet valve chamber 20 to actuate the two plungers 31,32 located in part in the cylinders 38,39 and inside of the spout itself. Plunger caps 33,34 seal the fuel in the plunger housing. The spout end of the nozzle is tapered at 3 and accommodates the trigger 21 and trigger spring 22. The spout end 2 has slots 4 that permit the latches 11,12 to pass through to engage with the restriction 201 in a fill pipe 200. Due to the latch sub-assembly being located within the interior of the spout, the spout inner diameter is expanded to permit a greater flow rate around these parts. This expansion runs from the rear or venturi end 6 to the trigger or distal end 3 where it tapers to a smaller diameter to be able to fit into a vehicle's fuel filler neck restrictor passage.

The latch retainer ring 13 is a metal ring that houses the right latch 11 and left latch 12 as well as the latch pin 14. This ring will transmit to the spout the longitudinal forces created by someone trying to remove the spout from the fill pipe without first removing the fuel pressure from the nozzle. The latch pin 14 slides through the latch retainer ring 13 and provides a fulcrum point for the latches and a solid means of transmitting force to the spout.

Once acted upon 53 by the plungers 31,32 under fuel pressure P the latches 11,12 rotate around the latch pin 14, to extend out 54 of the spout locking the entire fuel nozzle 1 in the filler pipe 200. A small hole 24 in the rear of the latch 11 accommodates the latch spring end 17 and a small hole 25 in the rear of the latch 12 accommodates the latch spring end 16.

To prevent fuel discharge outside a fuel tank fill pipe, a trigger mechanism is employed. The latches 11, 12 are free to pivot on latch pivot pin 14. The pivotal movement of the latches is controlled by the latch spring 15 and the plungers 31, 32 of the plunger assembly 30. The coil spring legs 16,17 are biased away from each other to withdraw 52 the lever hook ends 18,19 into the nozzle spout 2 when there is no pressure P on the plungers and the plungers had been pressed outward. The absence of fuel pump pressure P on the plungers 31, 32 allows the lever inner ends to be moved outwardly 51 under spring 15 pressure.

At the outer ends of the latches 11, 12 are extensions 18, 19 that are able to hook onto the restrictor plate 201 in the fill pipe 200 of a vehicle. The spring 15 extends between the inner ends of the latches 11,12 with ends 16,17, passing through the holes 24,25 in the rear of the latches. A spring force is produced that will push the rear of the latches apart and tend to push the plungers 31,32 back into the cylinders 38,39, and to continuously push the rear of the latches outward. Because of the relative pressure involved between the spring 15 and plungers, this movement can only happen when there is little or no fluid pressure to extend the actuator plungers toward the levers. In this depressurized mode, the latches are able to be retracted back inside of the spout 2 and enable the spout to be removed from the fill pipe. Removal allows the trigger spring 22 to push the trigger 21 over the venturi inlet 5 as well as the latch slots 4. The importance of this action is to protect the latches from being tampered with and prevent the venturi assembly from creating a vacuum as is the standard safety features in nozzles. By blocking the venturi inlet, the internal workings of the nozzle handle will not allow any gas to flow. Pulling the trigger back by hand in an attempt to steal gas will only result in a significant multi-directional spray from the end of the spout due to the configuration of the latches and the spout trigger guide slots. Therefore, to prevent gas spray and theft, the spout must be forced into the fill pipe where it pushes the trigger back and locks the latches behind the restrictor plate. In this embodiment, a trigger mechanism 21 is pushed back by the customer's insertion of the spout 2 into a fill pipe 200. This movement uncovers the latches 11,12 ends 18,19 and venturi inlet 5 against trigger spring 22 pressure. This will allow the latches to interlock with the fuel tank fuel filler neck restrictor 201 and the venturi to form a vacuum. This trigger will be held in place as long as fuel pressure is present and the latches are interlocked with the fuel restrictor.

Removal of pump pressure from the lever actuator allows the levers to be withdrawn due to spring action.

Figure 3:
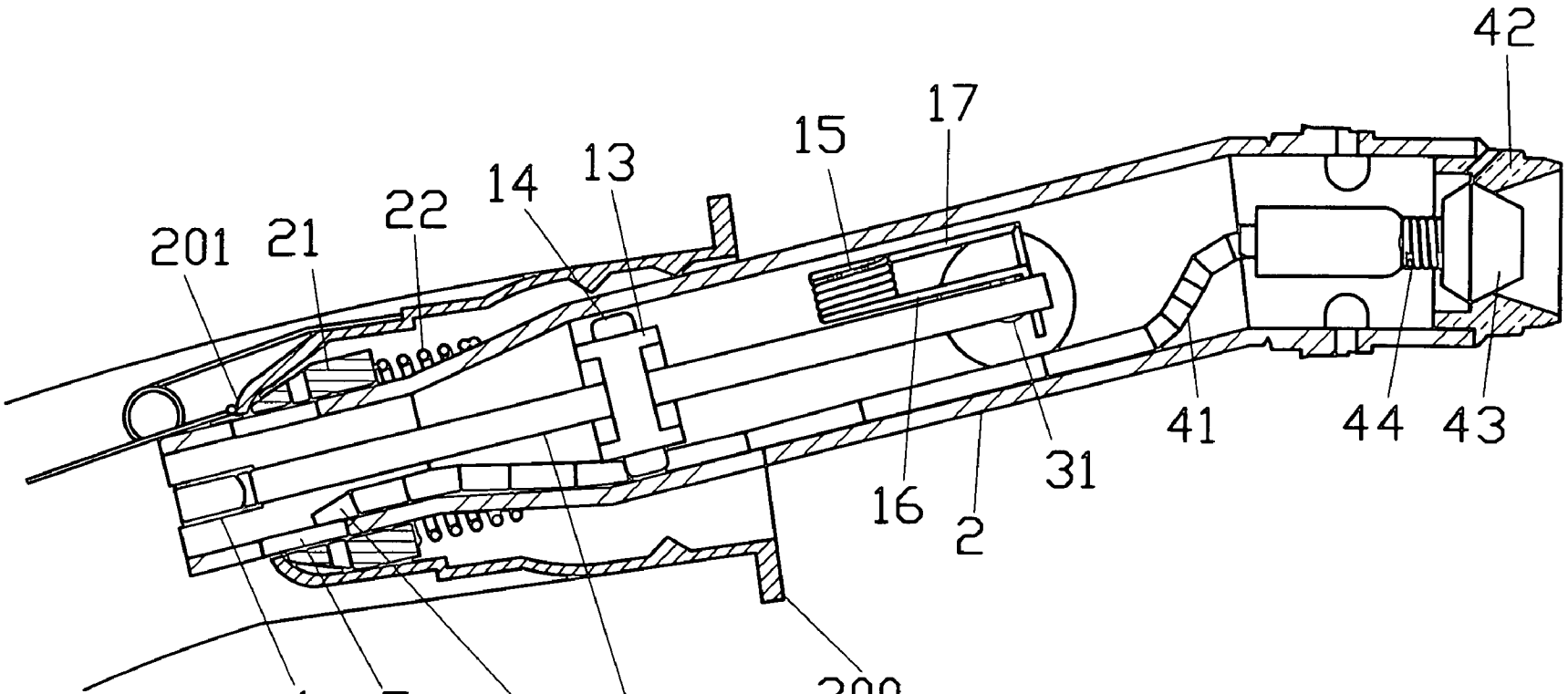
FIG. 3. is a sectional side view of the spout end of the fuel nozzle of the invention in a fill pipe.
Figure 4:
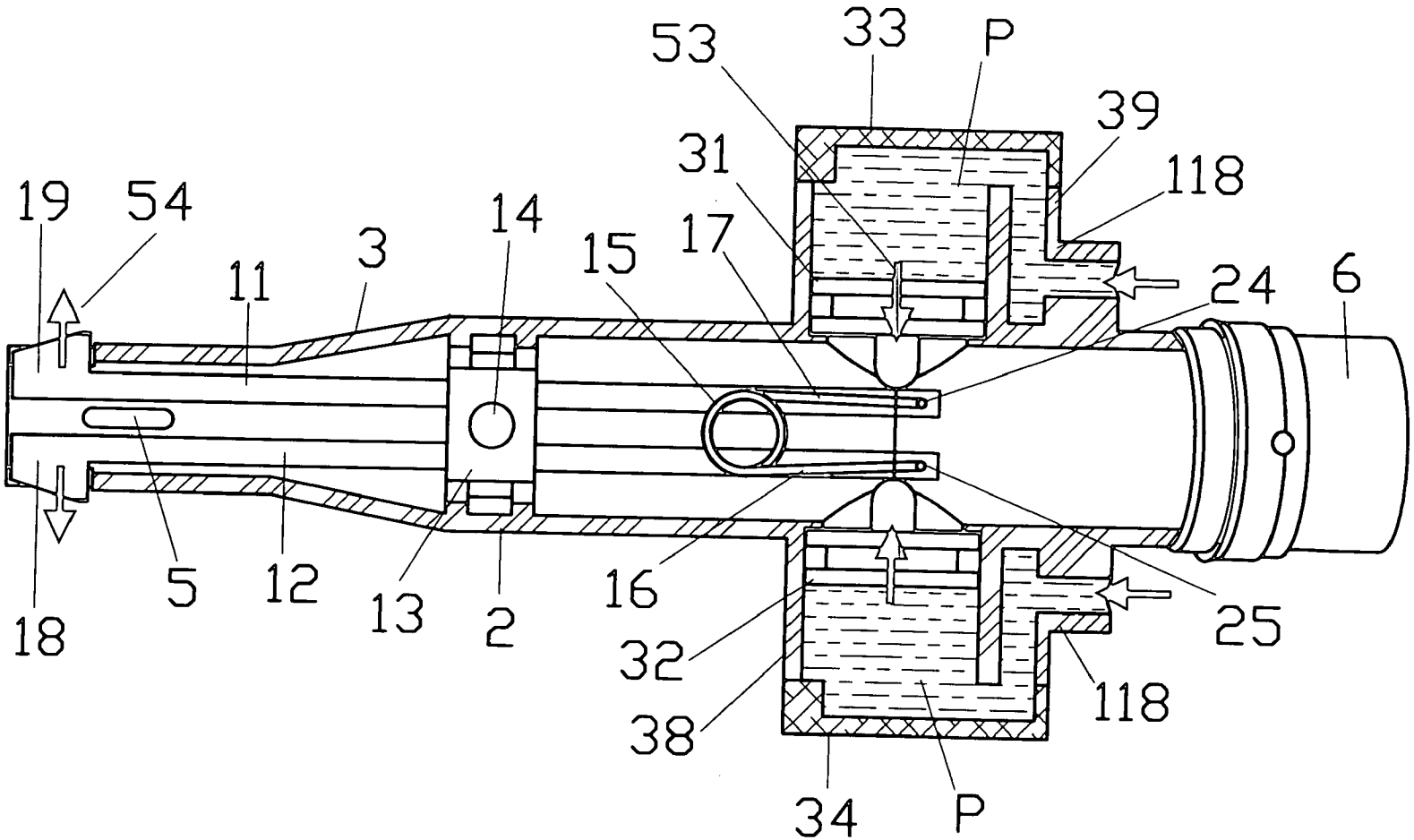
FIG. 4 is a sectional top view of the spout end of the fuel nozzle under fuel pressure.
Figure 5:
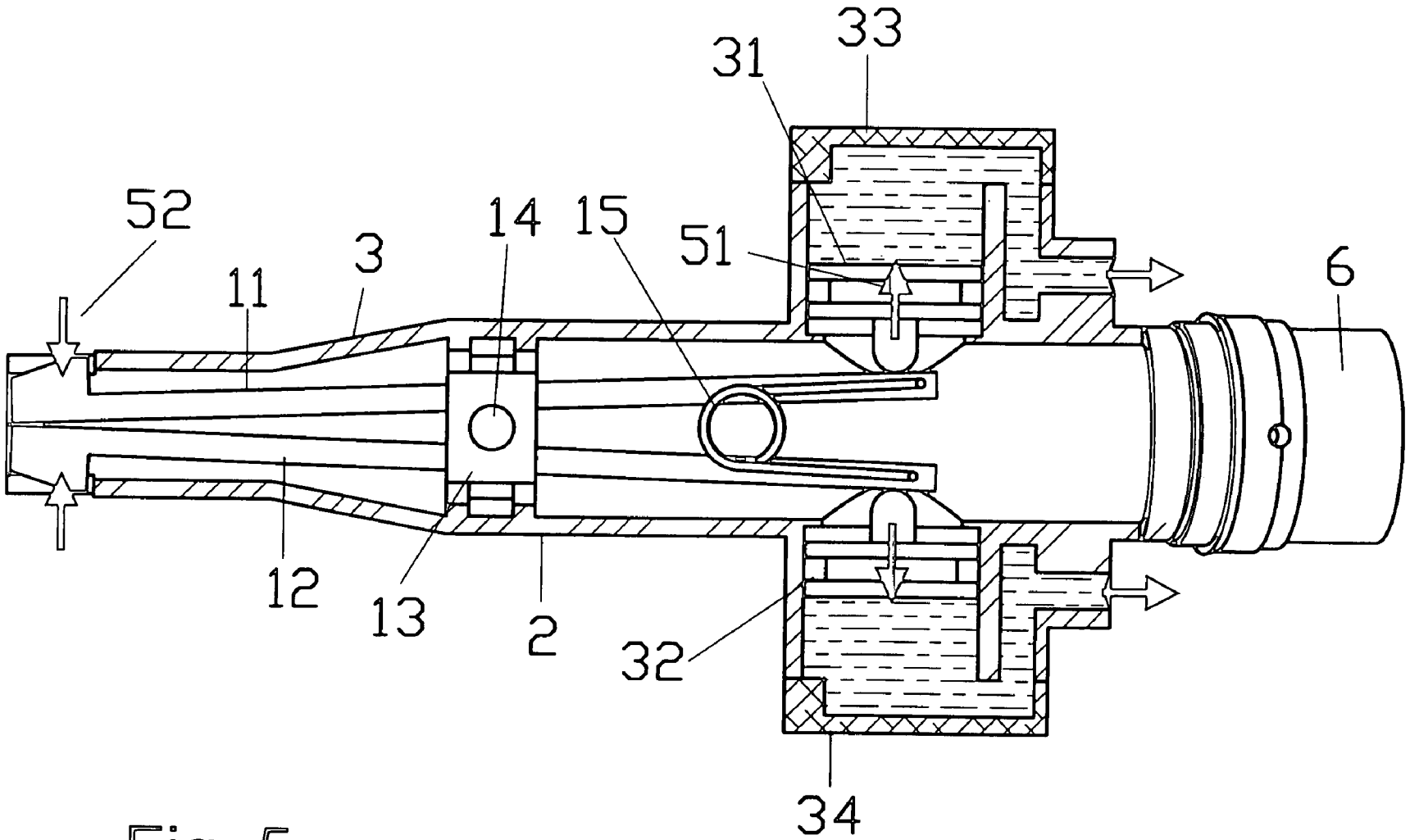
FIG. 5 is a sectional top view of the spout end of the fuel nozzle with pressure removal.
Figure 6:
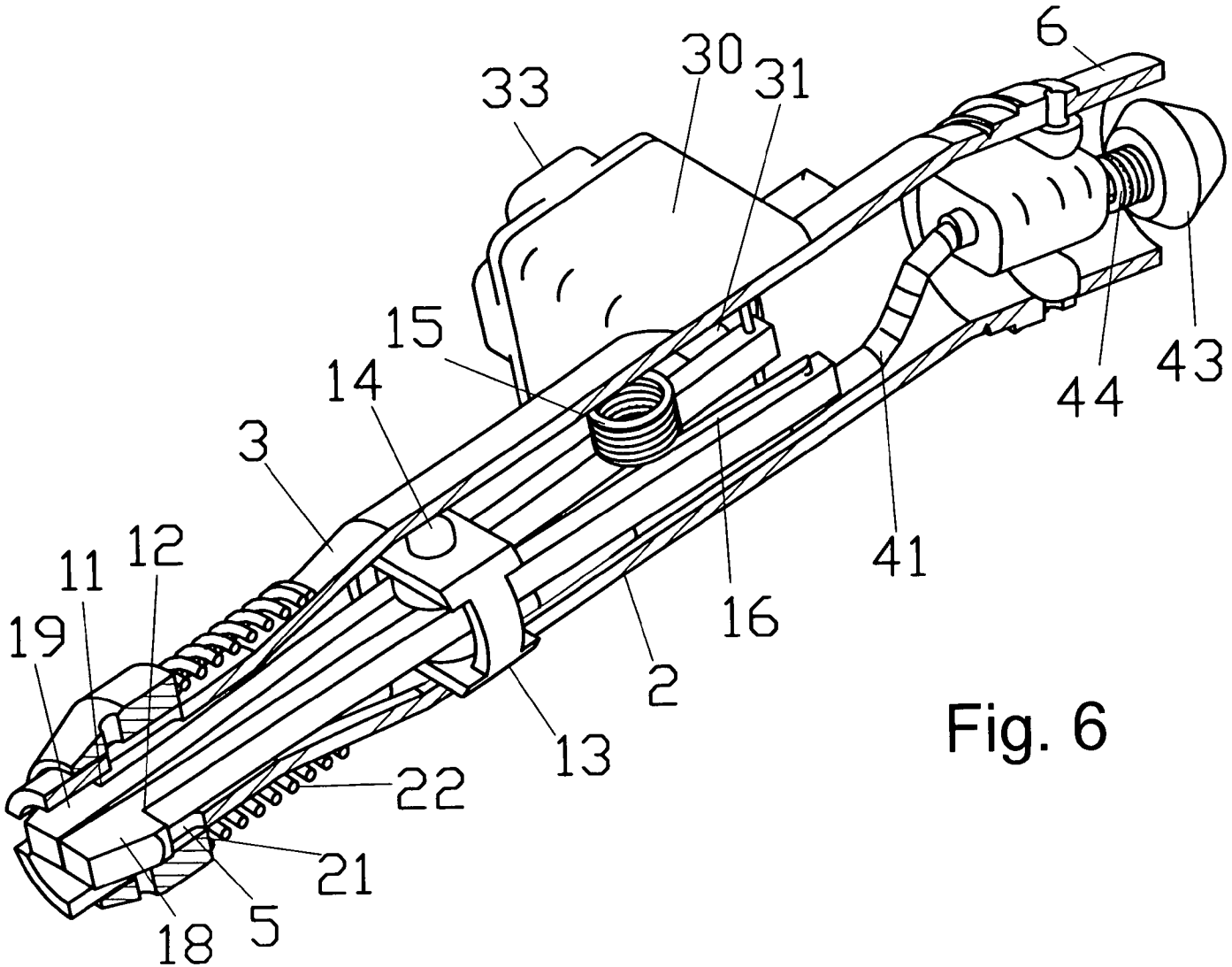
FIG. 6 is a perspective sectional view of the spout end of the fuel nozzle of the invention removed from a fill pipe.

The venturi sub-assembly is best seen in FIGS. 2 and 3, it is basically a standard component that can be found in existing spout designs. However, to cut costs and the quantity of components required, the internal workings of the spout have been integrated into the spout. By doing this, no extra parts have to be molded and the chance of an o-ring failure is virtually eliminated. The venturi tube 41 is the standard means of detecting that the fill pipe is full of fuel. The venturi produces a slight vacuum when fuel is flowing and sucks in air from the vent tube end 46 which has been routed to the distal end of the spout. The venturi also produces a vacuum over a chamber above a diaphragm in the plunger assembly 109 when the venturi inlet slot 5 is uncovered. This structure is standard in fuel nozzles. This venturi ring 42 is a plastic ring that provides a seat for the venturi plug 43 and is also responsible for the creation of the vacuum in the venturi tube. This situation is present in standard fuel nozzles. The venturi plug 43 is pushed back by the flow of gasoline when the handle lever is squeezed and fuel passes through the passage 108. By venturi spring 44 loading the plug, it can act like a throttle to provide a vacuum when a small amount of fuel is passing between the venturi plug 43 and the venturi ring 42. The venturi spring 44 loads the plug to help produce a vacuum. This structure is present in standard fuel nozzles. The venturi pin is a small pin that is anchored in the venturi housing 45 and ensures that the plug will stay aligned.

In operation, the pump is activated. When the pump is turned on, before the customer has even picked up the spout, 10 psi of fuel pressure is being supplied to the rear of the plungers 31, 32 through the handle tubes 101 and plunger passages 118 that run from the poppet valve chamber 20 to the spout 2. This pressure on the plungers is translated to press against the latches pushing their inner ends 24, 25 in and their outer ends 18, 19 out.

The consumer inserts the spout 2 into the fill pipe 200 of the vehicle. The trigger spring 22 wrapped around the outside of the spout at the straight distal end 2 is acted on by the trigger. By forcing the end 2 of the spout into a vehicle, the trigger assembly will make contact with the filler pipe 200 restrictor plate 201. As the trigger 21 compresses the trigger spring 22 it slides back and uncovers the venturi inlet 5 and spout slots 4 exposing the ends 18, 19 of the latches 11, 12. As soon as the trigger 21 is pushed back far enough to uncover the latch slots 4, the latches are allowed to pivot around the latch pin 14 as the plungers 31, 32 move inside the spout 2 and the outer ends 18,19 extend out from the spout.

The latch spring 15 is compressed and the extensions 18, 19 on the ends of the latch protrude from the spout through slots 4 and extend past the rim of the restrictor plate 201 effectively locking the spout 2 to the vehicle. This position is maintained as long as there is fuel pressure present on the plungers. When the pump is turned off, fuel pressure is removed from the nozzle body.

This pressure removal allows the latch spring 15 to force the plungers 31, 32 back into their cylinders 39, 38. At the same time the plungers are pushed back, the latches 11, 12 hook ends 18,19 are retracted back into the spout so that the entire assembly can be removed from the vehicle. When the latches are back in the spout 2, the trigger 21 moves out under trigger spring 22 pressure to again cover the trigger slots 4 and venturi openings 5.

Figure 7:
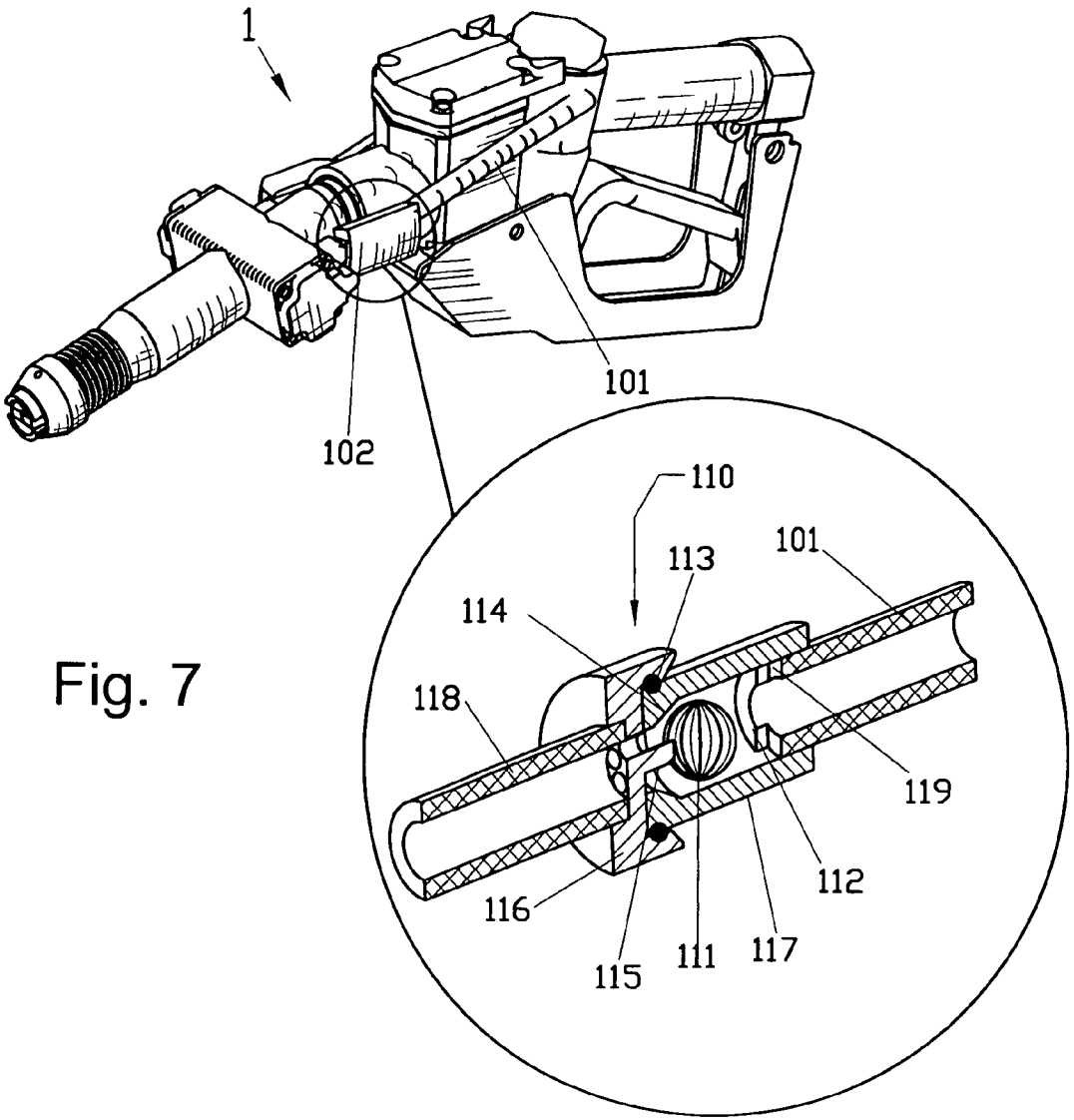
FIG. 7 is a sectional side view of a break-away joint for a nozzle drive away.

The introduction of fuel fill pipe grasps operated by fuel pump pressure also introduces an independent fuel spill passage for drive-offs. To comply with OSHA requirements, break-away joints 110 shown in FIG. 7 are placed in the fuel supply lines near the plunger assembly 30. The break-away joints are shown as being under the nozzle tube guard 102. The break-away joints are shown in the form of check valves. The break-away joint 110 has two separable components, a permanent coupling 117, firmly attached to or integral with the passage conduit 101, and a forceably removable break-away coupling 116, firmly attached to or integral with plunger passage 118. The break-away permanent coupling 117 houses a check ball 111 between the passage conduit 101 end and a tapered discharge 114 end. The break-away coupling 116 has a stop pin 115 integrally or otherwise securely attached internally to prevent the check ball from seating against the tapered discharge break-away seat 114 of the permanent coupling 117. The permanent coupling 117 and break-away coupling 116 are shown secured together by an "O" ring 113 of neoprene or other suitable plastic to firmly hold the two together without leakage.

Under normal operation, the permanent coupling 117 housing the check balls 111 is connected to the break-away coupling 116 and permits fuel to pass through plunger passage 118 to the plunger assembly 30 and permits fuel to escape back through the passage conduit 101 through slots 119 when the spring 15 presses the plungers back after fuel pressure is released. However, if a drive-off with the nozzle in the fill pipe occurs, the break-away coupling 116 will be jerked off of the permanent coupling 117. When this occurs, with pump fuel pressure present, the stop pin 115 will be removed with the break-away coupling 116 and fuel pressure will drive the check ball 111 against the tapered discharge 114 end, seating it there and precluding fuel from escaping.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. An interlocking fuel nozzle comprising:

an inlet for transporting fuel under pressure into said fuel nozzle;

a fuel spout having an inner end and an outer end for dispensing fuel from said fuel nozzle;

a latch means in said fuel spout for engaging a fuel tank fill pipe;

a plunger means operated by fuel under pressure at said fuel spout for pressing said latch means out of said spout to engage the fuel tank fill pipe;

a conduit for conducting fuel under pressure from said inlet to said plunger means at said fuel spout.

2. An interlocking fuel nozzle as in claim 1 wherein:

said latch means includes a first latch having an outer end and an inner end and a second latch having an outer end and an inner end;

said plunger means includes a first plunger and a second plunger;

said first latch is pressed outward by said first plunger and said second latch is pressed outward by said second plunger.

3. An interlocking fuel nozzle as in claim 2 including:

a spring for biasing said first latch and said second latch inward.

4. An interlocking fuel nozzle as in claim 3 including:

a hook on said first latch outer end and a hook on said second latch outer end.

5. An interlocking fuel nozzle as in claim 4 including:

a latch pivot pin between said first lever and said second lever outer ends and said first lever and said second lever inner ends about which said first lever and said second lever pivot.

6. An interlocking fuel nozzle as in claim 5 wherein:

said spring for biasing said first latch and said second latch is joined to said first lever inner end and to said second lever inner end.

7. An interlocking fuel nozzle as in claim 5 wherein:

said first plunger engages said first lever inner end and said second plunger engages said second lever inner end.

8. An interlocking fuel nozzle as in claim 6 wherein:

said first plunger engages said first lever inner end and said second plunger engages said second lever inner end.

9. An interlocking fuel nozzle as in claim 1 including:

a trigger surrounding said fuel spout outer end;

a trigger spring for biasing said trigger toward said fuel spout outer end.

10. An interlocking fuel nozzle as in claim 9 including:

slots in said fuel spout outer end for passage of said latch means for engaging a fuel tank fill pipe;

said trigger covers said slots to prevent said latch means from engaging said fuel tank fill pipe until said trigger is moved inward from said fuel spout outer end against said trigger spring bias.

11. An interlocking fuel nozzle as in claim 1 including:

a poppet valve housing and poppet valve for controlling fuel flow through said fuel spout;

said inlet for fuel under pressure into said fuel nozzle is in open communication with said poppet valve inlet side;

a poppet valve passage extending between said poppet valve inlet side and said plunger means for pressing said latch means out, to place said plunger means for pressing said latch means out under fuel inlet pressure.

12. An interlocking fuel nozzle as in claim 9 including:

a venturi slot in said fuel spout outer end for drawing in air during fuel flow to permit fuel flow to be stopped when the fuel tank fuel pipe is full of fuel;

said trigger covers said venturi slot and prevents air flow until said trigger is moved inward from said fuel spout outer end against said trigger spring bias.

13. An interlocking fuel nozzle as in claim 1 including:

a fuel passage between said inlet for fuel under pressure and said fuel spout outer end;

a venturi assembly in said fuel passage;

said venturi assembly having a venturi ring and a venturi plug and a venturi spring with said venturi plug biased by said venturi spring toward said venturi ring.

14. An interlocking fuel nozzle as in claim 13 including:

a venturi tube in said fuel spout between said venturi slot and said venturi plug for transmitting differences in pressure at said fuel spout to said venturi assembly.

15. An interlocking fuel nozzle as in claim 1 wherein:

said spout outer end has a diameter that is smaller than said spout inner end to accommodate said latch means within said spout inner end.

16. An interlocking fuel nozzle comprising:

an inlet for passing fuel under pressure into said fuel nozzle;

a fuel spout having an inner end and an outer end for discharging fuel from said fuel nozzle;

latch means at said fuel spout outer end for engaging a fuel tank fill pipe;

fuel pressure operated means at said fuel spout for pressing said latch means outward to engage a fuel tank fill pipe;

means for conducting said inlet fuel under pressure to said fuel pressure operated means at said fuel spout.

17. An interlocking fuel nozzle as in claim 16 including:

latch spring means for biasing said latch means inward to disengage said latch means from a fuel tank fill pipe when there is no fuel pressure present.

18. An interlocking fuel nozzle as in claim 17 including:

a trigger means at said fuel spout outer end to prevent said latch means from being pressed outward to engage a fuel tank fill pipe until said spout outer end is inserted into a fuel tank fill pipe.

19. An interlocking fuel nozzle comprising:

an inlet for fuel under pressure;

an outlet for dispensing fuel;

a valve between said inlet and outlet for controlling fuel dispensing;

a latch means for securing said fuel nozzle to a vehicle fill pipe;

a fuel pressure operated plunger means for operating said latch means;

a fuel passage between said inlet for fuel and said fuel pressure operated plunger means for operating said latch means that bypasses said valve between said inlet and outlet for controlling fuel dispensing.

20. An interlocking fuel nozzle as in claim 19 including:

a trigger means for blocking said latch means until said outlet for dispensing fuel is inserted into a vehicle fill pipe;

a break-away joint in said fuel passage between said inlet for fuel and said fuel pressure operated plunger means for blocking fuel flow in the event of drive away with said fuel nozzle in a vehicle fill pipe.

* * * * *